US007878268B2

(12) United States Patent
Chapman et al.

(10) Patent No.: US 7,878,268 B2
(45) Date of Patent: Feb. 1, 2011

(54) OILFIELD WELL PLANNING AND OPERATION

(75) Inventors: Clinton Chapman, Missouri City, TX (US); Chunling Gu Coffman, Houston, TX (US); Yongdong Zeng, Katy, TX (US); Mikhail Gurevich, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/333,368

(22) Filed: Dec. 12, 2008

(65) Prior Publication Data

US 2009/0152005 A1 Jun. 18, 2009

Related U.S. Application Data

(60) Provisional application No. 61/014,417, filed on Dec. 17, 2007.

(51) Int. Cl.
*E21B 7/00* (2006.01)
*G01V 9/00* (2006.01)

(52) U.S. Cl. ..... 175/57; 175/24; 702/9; 703/10

(58) Field of Classification Search ..... 175/24, 175/57; 702/9; 703/10
See application file for complete search history.

(56) References Cited

U.S. PATENT DOCUMENTS

| | | | |
|---|---|---|---|
| 5,139,094 | A | 8/1992 | Prevedel et al. |
| 5,680,906 | A | 10/1997 | Andrieux et al. |
| 5,899,958 | A | 5/1999 | Dowell et al. |
| 5,992,519 | A | 11/1999 | Ramakrishnan et al. |
| 6,266,619 | B1 | 7/2001 | Thomas et al. |
| 6,313,837 | B1 | 11/2001 | Assa et al. |
| 6,980,940 | B1 | 12/2005 | Gurpinar et al. |
| 7,003,439 | B2 | 2/2006 | Aldred et al. |
| 7,079,952 | B2 | 7/2006 | Thomas et al. |
| 2003/0168257 | A1 | 9/2003 | Aldred et al. |
| 2003/0216897 | A1 | 11/2003 | Endres et al. |
| 2004/0220846 | A1 | 11/2004 | Cullick et al. |
| 2005/0149307 | A1 | 7/2005 | Gurpinar et al. |
| 2005/0194182 | A1 * | 9/2005 | Rodney et al. ..... 175/24 |
| 2005/0209836 | A1 | 9/2005 | Klumpen et al. |
| 2005/0209886 | A1 | 9/2005 | Corkern |

(Continued)

FOREIGN PATENT DOCUMENTS

| | | |
|---|---|---|
| GB | 2392931 | 3/2004 |

(Continued)

*Primary Examiner*—Jennifer H Gay
*Assistant Examiner*—Yong-Suk Ro
(74) *Attorney, Agent, or Firm*—Osha Liang LLP

(57) ABSTRACT

A system for performing a drilling operation for an oilfield. The system includes a drilling system for advancing a drilling tool into a subterranean formation, a repository storing multiple survey factors for at least one wellsite of the oilfield and multiple drilling factors corresponding to at least one section of a planned trajectory of the at least one wellsite, and a processor and memory storing instructions when executed by the processor. The instructions include functionality to configure a drilling model for each of the at least one wellsite based on the plurality of survey factors and the plurality of drilling factors and selectively adjust the drilling model with respect to a plurality of drilling scenarios to generate an optimal drilling plan.

20 Claims, 10 Drawing Sheets

U.S. PATENT DOCUMENTS

| | | | | |
|---|---|---|---|---|
| 2005/0211468 | A1 | 9/2005 | Veeningen et al. | |
| 2005/0228905 | A1 | 10/2005 | Veeningen et al. | |
| 2005/0236184 | A1 | 10/2005 | Veeningen et al. | |
| 2005/0267719 | A1* | 12/2005 | Foucault | 703/10 |
| 2006/0197759 | A1 | 9/2006 | Fremming | |
| 2007/0112547 | A1 | 5/2007 | Ghorayeb et al. | |

FOREIGN PATENT DOCUMENTS

| | | |
|---|---|---|
| GB | 2411669 | 9/2005 |
| WO | 9964896 | 12/1999 |
| WO | 2004049216 | 6/2004 |

* cited by examiner

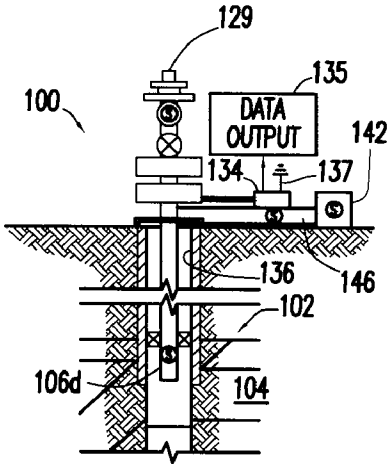
FIG. 1.4
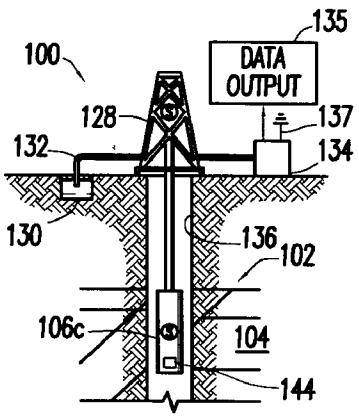
FIG. 1.3
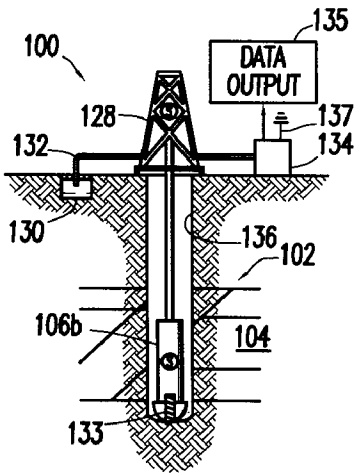
FIG. 1.2
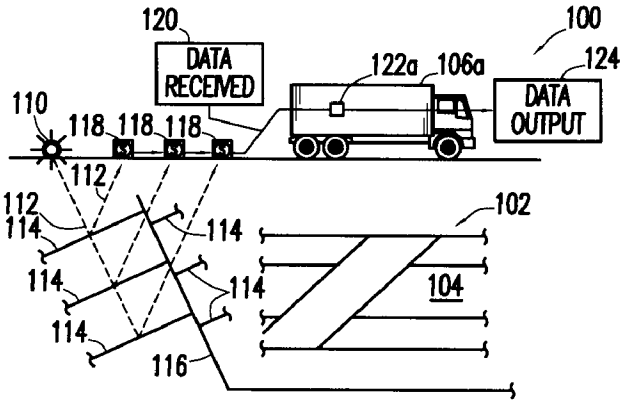
FIG. 1.1
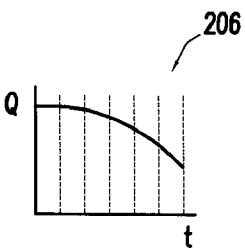
FIG. 2.4
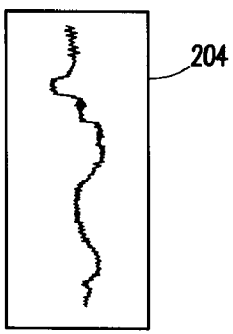
FIG. 2.3
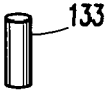
FIG. 2.2
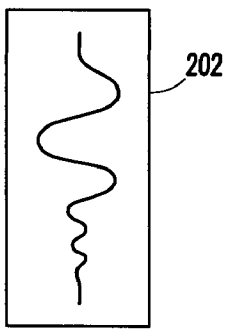
FIG. 2.1

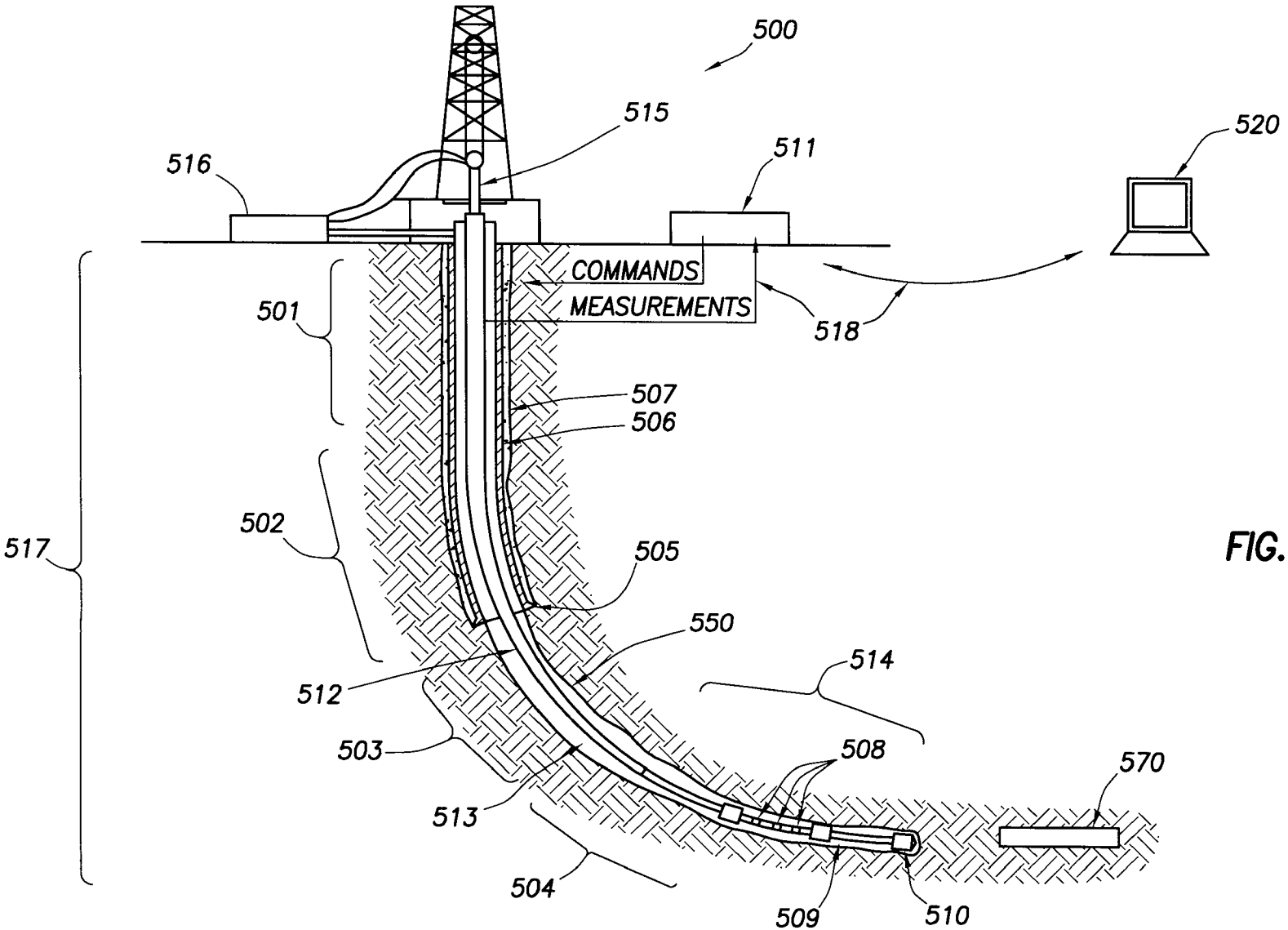
FIG.5.1

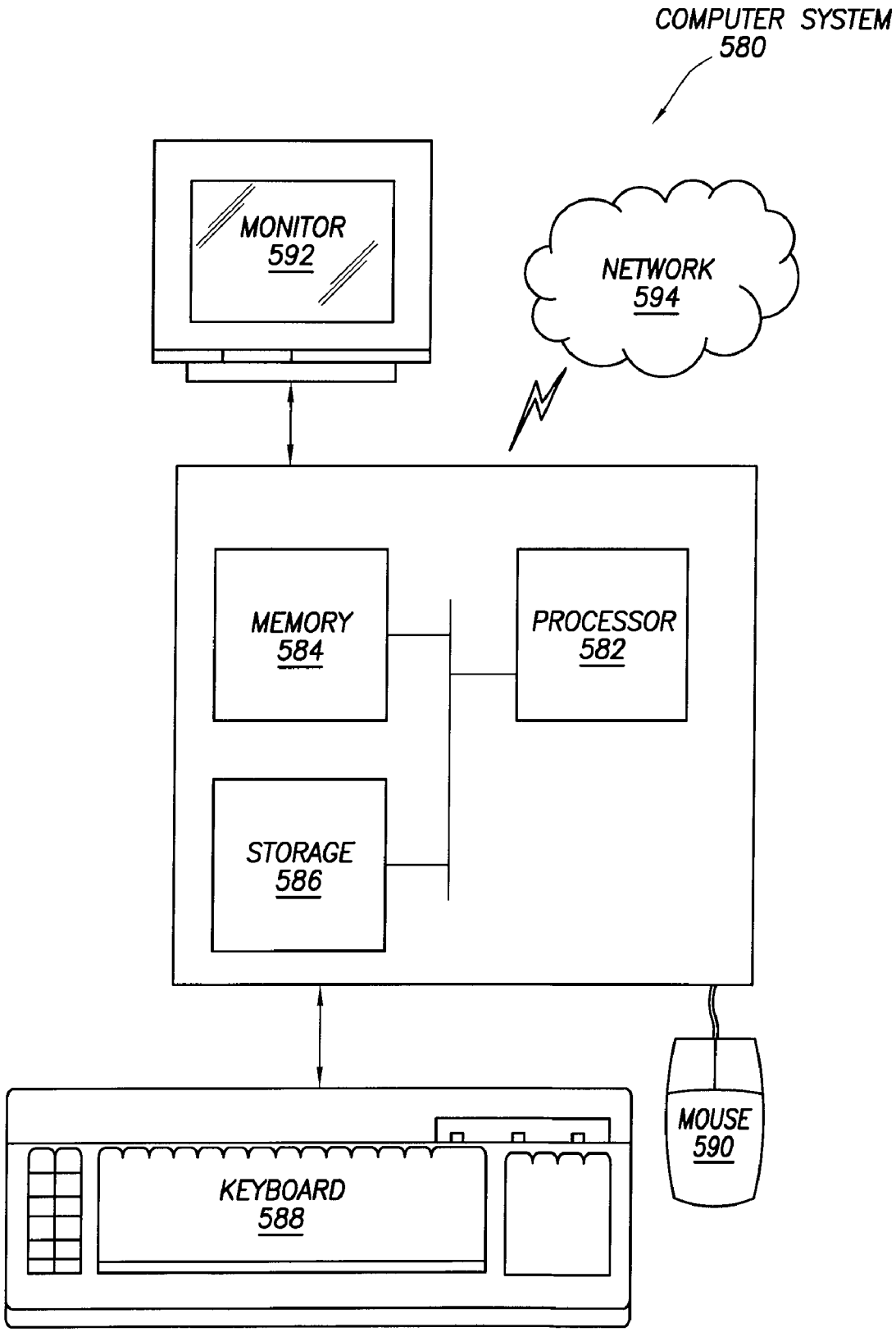
FIG.5.2

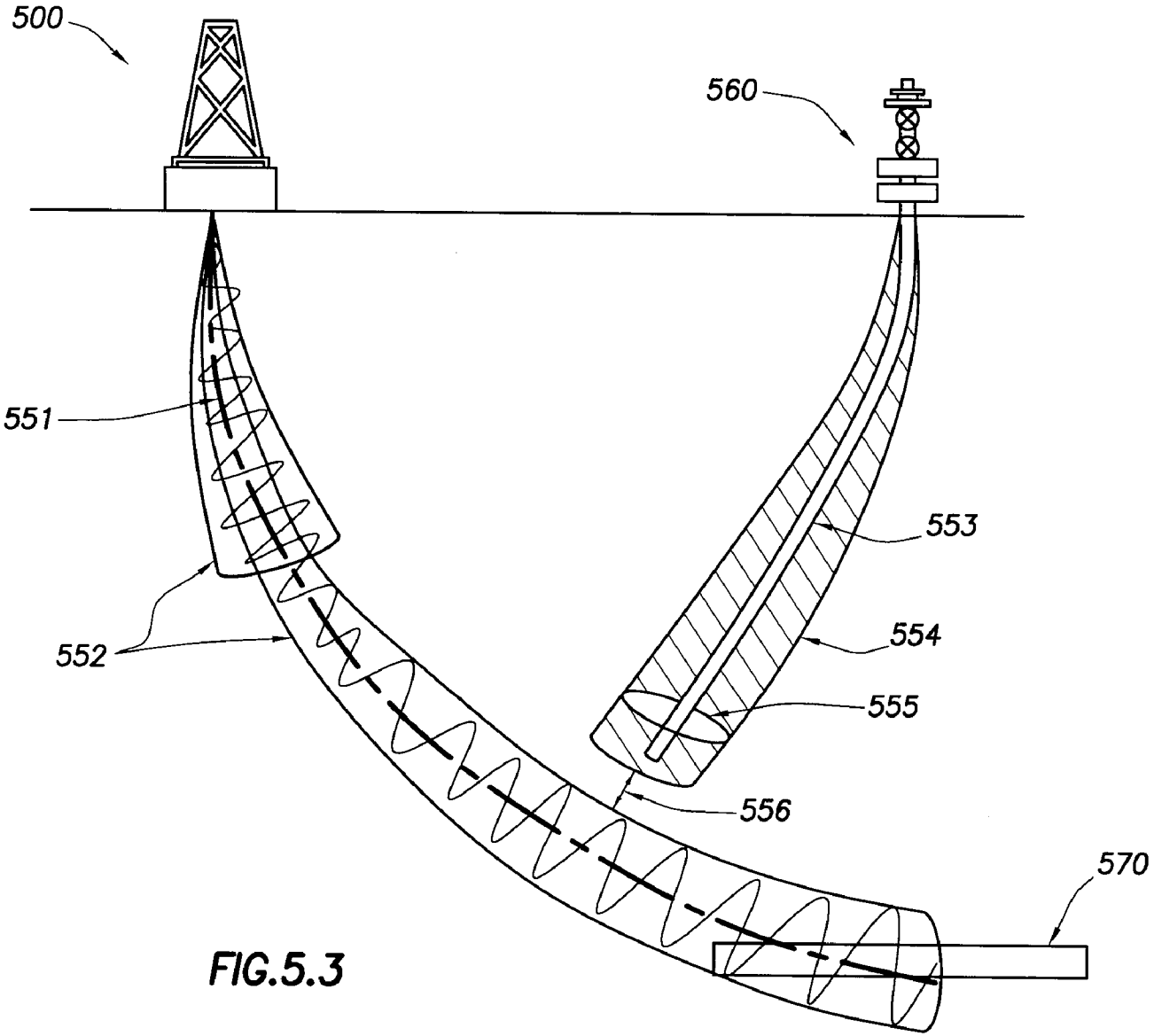
FIG.5.3

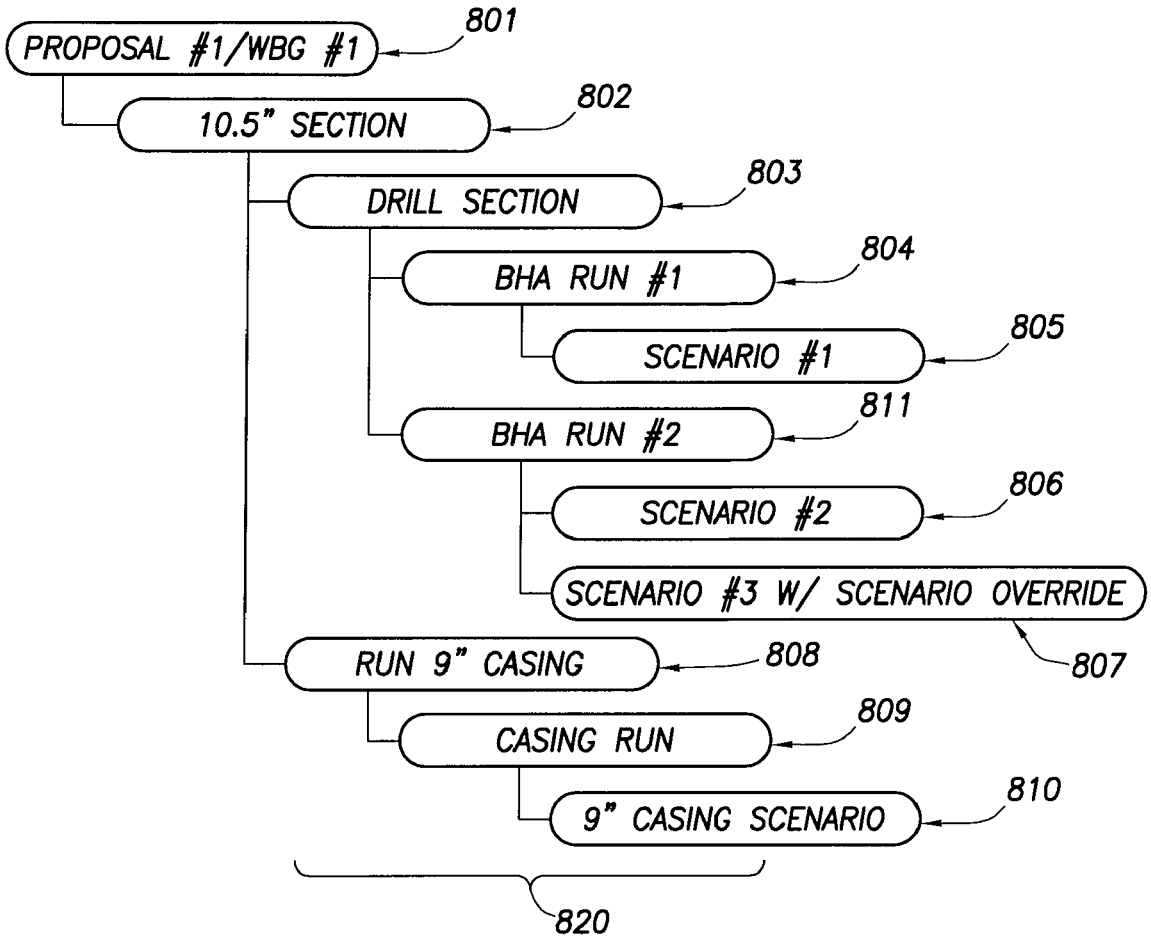
FIG.8.1
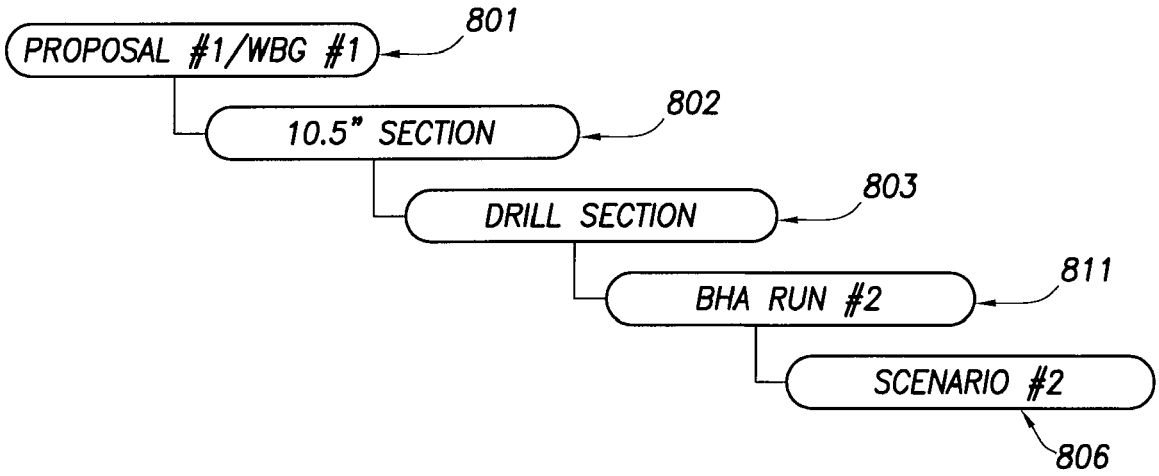
FIG.8.2

OILFIELD WELL PLANNING AND OPERATION

CROSS REFERENCE TO RELATED APPLICATION

This application claims priority pursuant to 35 U.S.C. §119 (e), to the filing date of U.S. Patent Application Ser. No. 61/014,417 entitled "METHOD AND SYSTEM FOR OILFIELD WELL PLANNING AND OPERATION," filed on Dec. 17, 2007, which is hereby incorporated by reference in its entirety.

BACKGROUND

Oilfield operations, such as surveying, drilling, wireline testing, completions, production, planning and oilfield analysis, are typically performed to locate and gather valuable downhole fluids. Various aspects of the oilfield and its related operations are shown in FIGS. 1.1-1.4. As shown in FIG. 1.1, surveys are often performed using acquisition methodologies, such as seismic scanners or surveyors to generate maps of underground formations. These formations are often analyzed to determine the presence of subterranean assets, such as valuable fluids or minerals. This information is used to assess the underground formations and locate the formations containing the desired subterranean assets. This information may also be used to determine whether the formations have characteristics suitable for storing fluids. Data collected from the acquisition methodologies may be evaluated and analyzed to determine whether such valuable items are present, and if they are reasonably accessible.

As shown in FIG. 1.2-1.4, one or more wellsites may be positioned along the underground formations to gather valuable fluids from the subterranean reservoirs. The wellsites are provided with tools capable of locating and removing hydrocarbons such as oil and gas, from the subterranean reservoirs. As shown in FIG. 1.2, drilling tools are typically deployed from the oil and gas rigs and advanced into the earth along a path to locate reservoirs containing the valuable downhole assets. Fluid, such as drilling mud or other drilling fluids, is pumped down the wellbore (or bore hole) through the drilling tool and out the drilling bit. The drilling fluid flows through the annulus between the drilling tool and the wellbore and out the surface, carrying away earth loosened during drilling. The drilling fluids return the earth to the surface, and seal the wall of the wellbore to prevent fluid in the surrounding earth from entering the wellbore and causing a 'blow out'.

During the drilling operation, the drilling tool may perform downhole measurements to investigate downhole conditions. The drilling tool may be used to take core samples of subsurface formations. In some cases, as shown in FIG. 1.3, the drilling tool is removed and a wireline tool is deployed into the wellbore to perform additional downhole testing, such as logging or sampling. Steel casing may be run into the well to a desired depth and cemented into place along the wellbore wall. Drilling may be continued until the desired total depth is reached.

After the drilling operation is complete, the well may then be prepared for production. As shown in FIG. 1.4, wellbore completions equipment is deployed into the wellbore to complete the well in preparation for the production of fluid therethrough. Fluid is then allowed to flow from downhole reservoirs, into the wellbore and to the surface. Production facilities are positioned at surface locations to collect the hydrocarbons from the wellsite(s). Fluid drawn from the subterranean reservoir(s) passes to the production facilities via transport mechanisms, such as tubing. Various equipments may be positioned about the oilfield to monitor oilfield parameters, to manipulate the oilfield operations and/or to separate and direct fluids from the wells. Surface equipment and completion equipment may also be used to inject fluids into reservoir either for storage or at strategic points to enhance production of the reservoir.

During the oilfield operations, data is typically collected for analysis and/or monitoring of the oilfield operations. Such data may include, for example, subterranean formation, equipment, historical and/or other data. Data concerning the subterranean formation is collected using a variety of sources. Such formation data may be static or dynamic. Static data relates to, for example, formation structure and geological stratigraphy that define the geological structures of the subterranean formation. Dynamic data relates to, for example, fluids flowing through the geologic structures of the subterranean formation over time. Such static and/or dynamic data may be collected to learn more about the formations and the valuable assets contained therein.

Sources used to collect static data may be seismic tools, such as a seismic truck that sends compression waves into the earth as shown in FIG. 1.1. Signals from these waves are processed and interpreted to characterize changes in the anisotropic and/or elastic properties, such as velocity and density, of the geological formation at various depths. This information may be used to generate basic structural maps of the subterranean formation. Other static measurements may be gathered using downhole measurements, such as core sampling and well logging techniques. Core samples may be used to take physical specimens of the formation at various depths as shown in FIG. 1.2. Well logging involves deployment of a downhole tool into the wellbore to collect various downhole measurements, such as density, resistivity, etc., at various depths. Such well logging may be performed using, for example, the drilling tool of FIG. 1.2 and/or the wireline tool of FIG. 1.3. Once the well is formed and completed, fluid flows to the surface using production tubing and other completion equipment as shown in FIG. 1.4. As fluid passes to the surface, various dynamic measurements, such as fluid flow rates, pressure, and composition may be monitored. These parameters may be used to determine various characteristics of the subterranean formation.

Sensors may be positioned about the oilfield to collect data relating to various oilfield operations. For example, sensors in the drilling equipment may monitor drilling conditions, sensors in the wellbore may monitor fluid composition, sensors located along the flow path may monitor flow rates and sensors at the processing facility may monitor fluids collected. Other sensors may be provided to monitor downhole, surface, equipment or other conditions. Such conditions may relate to the type of equipment at the wellsite, the operating setup, formation parameters or other variables of the oilfield. The monitored data is often used to make decisions at various locations of the oilfield at various times. Data collected by these sensors may be further analyzed and processed. Data may be collected and used for current or future operations. When used for future operations at the same or other locations, such data may sometimes be referred to as historical data.

The data may be used to predict downhole conditions, and make decisions concerning oilfield operations. Such decisions may involve well planning, well targeting, well completions, operating levels, production rates and other operations and/or operating parameters. Often this information is used to determine when to drill new wells, re-complete existing wells or alter wellbore production. Oilfield conditions, such as geological, geophysical and reservoir engineering characteristics, may have an impact on oilfield operations, such as risk analysis, economic valuation, and mechanical considerations for the production of subsurface reservoirs.

Data from one or more wellbores may be analyzed to plan or predict various outcomes at a given wellbore. In some cases, the data from neighboring wellbores, or wellbores with similar conditions or equipment may be used to predict how a well will perform. There are usually a large number of variables and large quantities of data to consider in analyzing oilfield operations. It is, therefore, often useful to model the behavior of the oilfield operation to determine the desired course of action. During the ongoing operations, the operating parameters may be adjusted as oilfield conditions change and new information is received.

SUMMARY

The invention relates to a system for performing a drilling operation for an oilfield. The system includes a drilling system for advancing a drilling tool into a subterranean formation, a repository storing multiple survey factors for at least one wellsite of the oilfield and multiple drilling factors corresponding to at least one section of a planned trajectory of the at least one wellsite, a processor, and memory storing instructions when executed by the processor. The instructions include functionality to configure a drilling model for each of the at least one wellsite based on the plurality of survey factors and the plurality of drilling factors and selectively adjust the drilling model with respect to a plurality of drilling scenarios to generate an optimal drilling plan.

Other aspects of the invention will be apparent from the following description and the appended claims.

BRIEF DESCRIPTION OF DRAWINGS

So that the above described features of the oilfield well planning and operation can be understood in detail, a more particular description of the oilfield well planning and operation, briefly summarized above, may be had by reference to the embodiments thereof that are illustrated in the appended drawings. It is to be noted, however, that the appended drawings illustrate typical embodiments of this oilfield well planning and operation and are therefore not to be considered limiting of its scope, for the oilfield well planning and operation may admit to other equally effective embodiments.

FIGS. 1.1-1.4 depict a schematic view of an oilfield having subterranean structures containing reservoirs therein, various oilfield operations being performed on the oilfield.

FIGS. 2.1-2.4 show graphical depictions of data collected by the tools of FIGS. 1A-D, respectively.

FIG. 5.1 shows a schematic diagram depicting drilling operation of a directional well in multiple sections.

FIG. 5.2 shows a computer system for a modeling tool of the drilling operation.

FIG. 5.3 shows a schematic diagram depicting anti-collision analysis.

FIG. 8.1 shows a schematic diagram depicting context representation in a drilling model.

FIG. 8.2 shows a schematic diagram depicting a context extracted based on a scenario in a drilling model.

DETAILED DESCRIPTION

Figure 3:
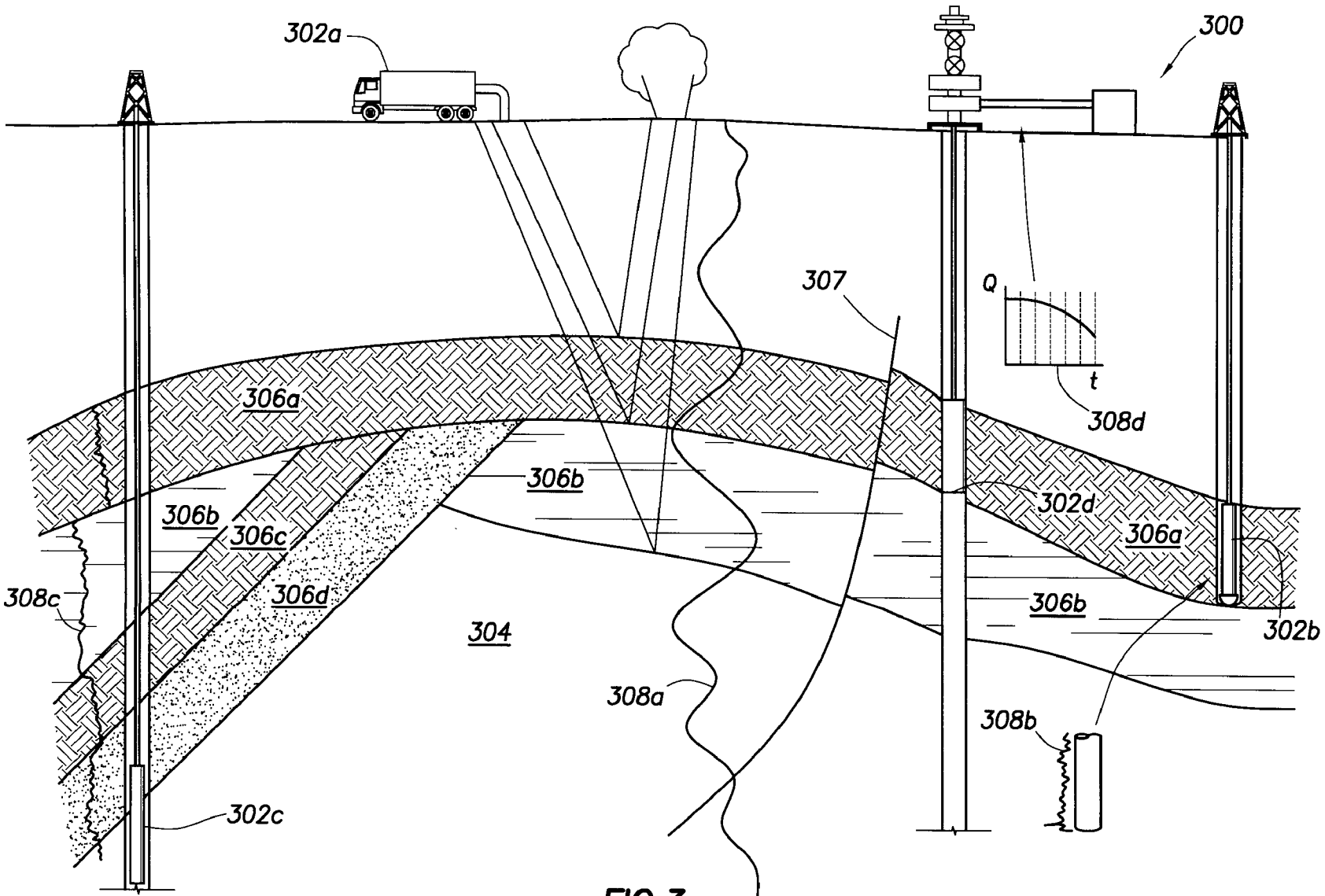
FIG. 3 is a schematic view, partially in cross section of an oilfield having a plurality of data acquisition tools positioned at various locations along the oilfield for collecting data from the subterranean formations.

Specific embodiments will now be described in detail with reference to the accompanying figures. Like elements in the various figures are denoted by like reference numerals for consistency.

In the following detailed description of embodiments of the oilfield well planning and operation, numerous specific details are set forth in order to provide a more thorough understanding. In other instances, well-known features have not been described in detail to avoid obscuring the oilfield well planning and operation.

The oilfield well planning and operation involves applications generated for the oil and gas industry. More particularly, the oilfield well planning and operation relates to techniques for performing drilling operations involving an analysis of drilling equipment, drilling conditions, and other oilfield parameters that impact the drilling operations.

FIGS. 1.1-1.4 depict simplified, representative, schematic views of an oilfield (100) having subterranean formation (102) containing reservoir (104) therein and depicting various oilfield operations being performed on the oilfield (100). FIG. 1.1 depicts a survey operation being performed by a survey tool, such as seismic truck (106*a*) to measure properties of the subterranean formation. The survey operation is a seismic survey operation for producing sound vibrations (112). In FIG. 1.1, one such sound vibration (112) generated by a source (110) and reflects off a plurality of horizons (114) in an earth formation (116). The sound vibration(s) (112) is (are) received in by sensors (S), such as geophone-receivers (118), situated on the earth's surface, and the geophone-receivers (118) produce electrical output signals, referred to as data received (120) in FIG. 1.

In response to the received sound vibration(s) (112) representative of different parameters (such as amplitude and/or frequency) of the sound vibration(s) (112), the geophones (118) produce electrical output signals containing data concerning the subterranean formation. The data received (120) is provided as input data to a computer (122*a*) of the seismic truck (106*a*), and responsive to the input data, the computer (122*a*) generates a seismic data output record (124). The seismic data may be stored, transmitted or further processed as desired, for example by data reduction.

FIG. 1.2 depicts a drilling operation being performed by a drilling tools (106*b*) suspended by a rig (128) and advanced into the subterranean formations (102) to form a wellbore (136). A mud pit (130) is used to draw drilling mud into the drilling tools (106*b*) via flow line (132) for circulating drilling mud through the drilling tools (106*b*), up the wellbore and back to the surface. The drilling tools (106*b*) are advanced into the subterranean formations to reach reservoir (104). Each well may target one or more reservoirs. The drilling tools (106*b*) may be adapted for measuring downhole properties using logging while frilling tools. The logging while drilling tool (106*b*) may also be adapted for taking a core sample (133) as shown, or removed so that a core sample (133) may be taken using another tool.

A surface unit (134) is used to communicate with the drilling tools (106*b*) and/or offsite operations. The surface unit (134) is capable of communicating with the drilling tools (106*b*) to send commands to the drilling tools, and to receive data therefrom. The surface unit (134) may be provided with computer facilities for receiving, storing, processing, and/or analyzing data from the oilfield (100). The surface unit (134) collects data generated during the drilling operation and produces data output (135) which may be stored or transmitted. Computer facilities, such as those of the surface unit (134), may be positioned at various locations about the oilfield (100) and/or at remote locations.

Sensors (S), such as gauges, may be positioned about the oilfield to collect data relating to various oilfields operations as described previously As shown, the sensor (S) is positioned in one or more locations in the drilling tools and/or at the rig to measure drilling parameters, such as weight on bit, torque on bit, pressures, temperatures, flow rates, compositions, rotary speed and/or other parameters of the oilfield operation. Sensor may also be positioned in one or more locations in the circulating system.

The data gathered by the sensors (S) may be collected by the surface unit (134) and/or other data collection sources for analysis or other processing. The data collected by the sensors (S) may be used alone or in combination with other data. The data may be collected in one or more databases and/or transmitted on or offsite. All or select portions of the data may be selectively used for analyzing and/or predicting oilfield operations of the current and/or other wellbores. The data may be historical data, real time data or combinations thereof. The real time data may be used in real time, or stored for later use. The data may also be combined with historical data or other inputs for further analysis. The data may be stored in separate databases, or combined into a single database.

Data outputs from the various sensors (S) positioned about the oilfield may be processed for use. The data may be historical data, real time data, or combinations thereof. The real time data may be used in real time, or stored for later use. The data may also be combined with historical data or other inputs for further analysis. The data may be housed in separate databases, or combined into a single database.

The collected data may be used to perform analysis, such as modeling operations. For example, the seismic data output may be used to perform geological, geophysical, and/or reservoir engineering. The reservoir, wellbore, surface and/or process data may be used to perform reservoir, wellbore, geological, geophysical or other simulations. The data outputs from the oilfield operation may be generated directly from the sensors (S), or after some preprocessing or modeling. These data outputs may act as inputs for further analysis.

The data is collected and stored at the surface unit (134). One or more surface units (134) may be located at the oilfield (100), or connected remotely thereto. The surface unit (134) may be a single unit, or a complex network of units used to perform the necessary data management functions throughout the oilfield (100). The surface unit (134) may be a manual or automatic system. The surface unit (134) may be operated and/or adjusted by a user.

The surface unit (134) may be provided with a transceiver (137) to allow communications between the surface unit (134) and various portions of the oilfield (100) or other locations. The surface unit (134) may also be provided with or functionally connected to one or more controllers for actuating mechanisms at the oilfield (100). The surface unit (134) may then send command signals to the oilfield (100) in response to data received. The surface unit (134) may receive commands via the transceiver or may itself execute commands to the controller. A processor may be provided to analyze the data (locally or remotely) and make the decisions and/or actuate the controller. In this manner, the oilfield (100) may be selectively adjusted based on the data collected. This technique may be used to optimize portions of the oilfield operation, such as controlling drilling, weight on bit, pump rates or other parameters. These adjustments may be made automatically based on computer protocol, and/or manually by an operator. In some cases, well plans may be adjusted to select optimum operating conditions, or to avoid problems.

FIG. 1.3 depicts a wireline operation being performed by a wireline tool (106*c*) suspended by the rig (128) and into the wellbore (136) of FIG. 1.2. The wireline tool (106*c*) may be adapted for deployment into a wellbore (136) for generating well logs, performing downhole tests and/or collecting samples. The wireline tool (106*c*) may be used to provide another method and apparatus for performing a seismic survey operation. The wireline tool (106*c*) of FIG. 1.3 may, for example, have an explosive, radioactive, electrical, or acoustic energy source (144) that sends and/or receives electrical signals to the surrounding subterranean formations (102) and fluids therein.

The wireline tool (106*c*) may be operatively connected to, for example, the geophones (118) stored in the computer (122*a*) of the seismic truck (106*a*) of FIG. 1.1. The wireline tool (106*c*) may also provide data to the surface unit (134). The surface unit collects data generated during the wireline operation and produces data output 135 that may be stored or transmitted. The wireline tool (106*c*) may be positioned at various depths in the wellbore (136) to provide a survey or other information relating to the subterranean formation.

Sensors (S), such as gauges, may be positioned about the oilfield to collect data relating to various oilfield operations as described previously. As shown, the sensor S is positioned in the wireline tool to measure downhole parameters, which relate to, for example porosity, permeability, fluid composition and/or other parameters of the oilfield operation.

FIG. 1.4 depicts a production operation being performed by a production tool (106*d*) deployed from a production unit or Christmas tree (129) and into the completed wellbore (136) of FIG.1C for drawing fluid from the downhole reservoirs into the surface facilities (142). Fluid flows from reservoir (104) through perforations in the casing (not shown) and into the production tool (106*d*) in the wellbore (136) and to the surface facilities (142) via a gathering network (146).

Sensors (S), such as gauges, may be positioned about the oilfield to collect data relating to various oilfield operations as described previously. As shown, the sensor (S) may be positioned in the production tool (106*d*) or associated equipment, such as the Christmas tree, gathering network, surface facilities and/or the production facility, to measure fluid parameters, such as fluid composition, flow rates, pressures, temperatures, and/or other parameters of the production operation.

Although simplified wellsite configurations are shown, it will be appreciated that the oilfield may cover a portion of land, sea and/or water locations that hosts one or more wellsites. Production may also include injection wells (not shown) for added recovery. One or more gathering facilities may be operatively connected to one or more of the wellsites for selectively collecting downhole fluids from the wellsite (s).

While FIGS. 1.2-1.4 depict tools used to measure properties of an oilfield (100), it will be appreciated that the tools may be used in connection with non-oilfield operations, such as mines, aquifers, storage or other subterranean facilities. Also, while certain data acquisition tools are depicted, it will be appreciated that various measurement tools capable of sensing parameters, such as seismic two-way travel time, density, resistivity, production rate, etc., of the subterranean formation and/or its geological formations may be used. Various sensors (S) may be located at various positions along the wellbore and/or the monitoring tools to collect and/or monitor the desired data. Other sources of data may also be provided from offsite locations.

The oilfield configuration in FIGS. 1.1-1.4 are intended to provide a brief description of an example of an oilfield usable with the oilfield well planning and operation. Part, or all, of the oilfield (100) may be on land and/or sea. Also, while a single oilfield measured at a single location is depicted, the oilfield well planning and operation may be utilized with any combination of one or more oilfields (100), one or more processing facilities and one or more wellsites.

FIGS. 2.1-2.4 are graphical depictions of examples of data collected by the tools of FIGS. 1.1-1.4, respectively. FIG. 2.1 depicts a seismic trace (202) of the subterranean formation of FIG. 1.1 taken by seismic truck (106*a*). The seismic trace may be used to provide data, such as a two-way response over a period of time. FIG. 2.2 depicts a core sample (133) taken by the drilling tools (106*b*). The core sample may be used to provide data, such as a graph of the density, porosity, permeability or other physical property of the core sample (133) over the length of the core. Tests for density and viscosity may be performed on the fluids in the core at varying pressures and temperatures. FIG. 2.3 depicts a well log (204) of the subterranean formation of FIG. 1.3 taken by the wireline tool (106*c*). The wireline log typically provides a resistivity or other measurement of the formations at various depts. FIG. 2.4 depicts a production decline curve or graph (206) of fluid flowing through the subterranean formation of FIG. 1.4 measured at the surface facilities (142). The production decline curve (206) typically provides the production rate Q as a function of time t.

The respective graphs of FIGS. 2.1-2.3 depict examples of static measurements that may describe information about the physical characteristics of the formation and reservoirs contained therein. These measurements may be analyzed to better define the properties of the formation(s) and/or determine the accuracy of the measurements and/or for checking for errors. The plots of each of the respective measurements may be aligned and scaled for comparison and verification of the properties.

FIG. 2.4 depicts an example of a dynamic measurement of the fluid properties through the wellbore. As the fluid flows through the wellbore, measurements are taken of fluid properties, such as flow rates, pressures, composition, etc. As described below, the static and dynamic measurements may be analyzed and used to generate models of the subterranean formation to determine characteristics thereof. Similar measurements may also be used to measure changes in formation aspects over time.

FIG. 3 is a schematic view, partially in cross section of an oilfield (300) having data acquisition tools (302*a*), (302*b*), (302*c*), and (302*d*) positioned at various locations along the oilfield for collecting data of a subterranean formation (304). The data acquisition tools (302*a*-302*d*) may be the same as data acquisition tools (106*a*-106*d*) of FIGS. 1.1-1.4, respectively, or others not depicted. As shown, the data acquisition tools (302*a*-302*d*) generate data plots or measurements (308*a*-308*d*), respectively. These data plots are depicted along the oilfield to demonstrate the data generated by various operations.

Data plots (308*a*-308*c*) are examples of static data plots that may be generated by the data acquisition tools (302*a*-302*d*), respectively. Static data plot (308*a*) is a seismic two-way response time and may be the same as the seismic trace (202) of FIG. 2.1. Static plot (308*b*) is core sample data measured from a core sample of the formation (304), similar to the core sample (133) of FIG. 2.2. Static data plot (308*c*) is a logging trace, similar to the well log (204) of FIG. 2.3. Production decline curve or graph (308*d*) is a dynamic data plot of the fluid flow rate over time, similar to the graph (206) of FIG. 2.4. Other data may also be collected, such as historical data, user inputs, economic information, and/or other measurement data and other parameters of interest.

The subterranean formation (304) has a plurality of geological formations (306*a*-306*d*). As shown, the structure has several formations or layers, including a shale layer (306*a*), a carbonate layer (306*b*), a shale layer (306*c*) and a sand layer (306*d*). A fault line (307) extends through the layers (306*a*, 306*b*). The static data acquisition tools may be adapted to take measurements and detect the characteristics of the formations.

While a specific subterranean formation (304) with specific geological structures are depicted, it will be appreciated that the oilfield may contain a variety of geological structures and/or formations, sometimes having extreme complexity. In some locations, typically below the water line, fluid may occupy pore spaces of the formations. Each of the measurement devices may be used to measure properties of the formations and/or its geological features. While each acquisition tool is shown as being in specific locations in the oilfield, it will be appreciated that one or more types of measurement may be taken at one or more location across one or more oilfields or other locations for comparison and/or analysis.

Figure 4:
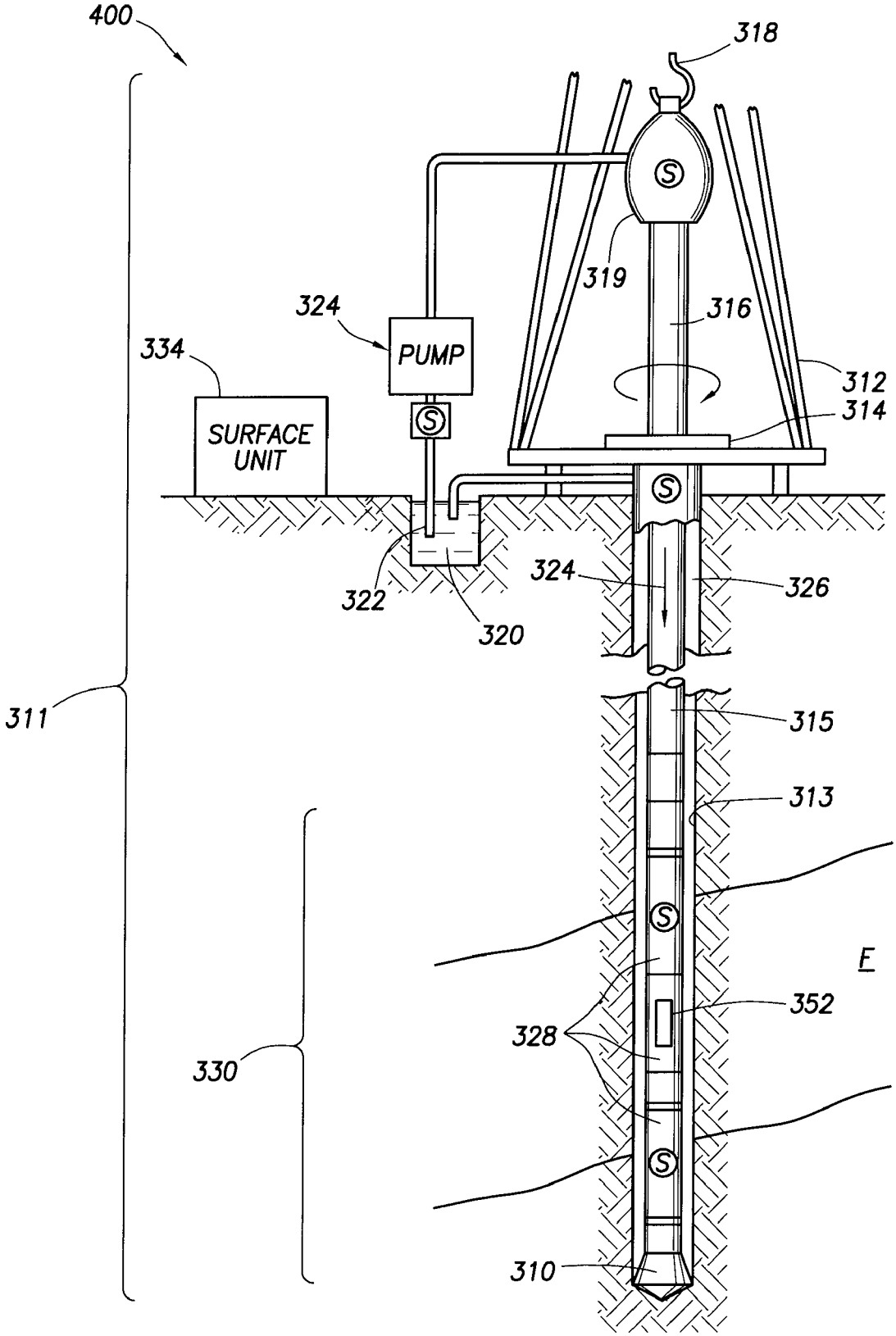
FIG. 4 depicts a schematic view, partially in cross-section of a drilling operation of an oilfield.

FIG. 4 is a schematic view of a wellsite (400) depicting a drilling operation, such as the drilling operation of FIG. 1B, of an oilfield in detail.

The wellsite system (400) includes a drilling system (311) and a surface unit (334). In the illustrated embodiment, a borehole (313) is formed by rotary drilling in a manner that is well known. Those of ordinary skill in the art given the benefit of this disclosure will appreciate, however, that the present invention also finds application in drilling applications other than conventional rotary drilling (e.g., mud-motor based directional drilling), and is not limited to land-based rigs.

The drilling system (311) includes a drill string (315) suspended within the borehole (313) with a drill bit (310) at its lower end. The drilling system (311) also includes the land-based platform and derrick assembly (312) positioned over the borehole (313) penetrating a subsurface formation (F). The assembly (312) includes a rotary table (314), kelly (316), hook (318) and rotary swivel (319). The drill string (315) is rotated by the rotary table (314), energized by means not shown, which engages the kelly (316) at the upper end of the drill string. The drill string (315) is suspended from hook (318), attached to a traveling block (also not shown), through the kelly (316) and a rotary swivel (319) which permits rotation of the drill string relative to the hook.

The drilling system (311) further includes drilling fluid or mud (320) stored in a pit (322) formed at the well site. A pump (324) delivers the drilling fluid (320) to the interior of the drill string (315) via a port in the swivel (319), inducing the drilling fluid to flow downwardly through the drill string (315) as indicated by the directional arrow (324). The drilling fluid exits the drill string (315) via ports in the drill bit (310), and then circulates upwardly through the region between the outside of the drill string and the wall of the borehole, called the annulus (326). In this manner, the drilling fluid lubricates the drill bit (310) and carries formation cuttings up to the surface as it is returned to the pit (322) for recirculation.

The drill string (315) further includes a bottom hole assembly (BHA), generally referred to as (330), near the drill bit (310) (in other words, within several drill collar lengths from the drill bit). The bottom hole assembly (330) includes capabilities for measuring, processing, and storing information, as well as communicating with the surface unit. The BHA (330) further includes drill collars (328) for performing various other measurement functions.

Sensors (S) are located about the wellsite to collect data, may be in real time, concerning the operation of the wellsite, as well as conditions at the wellsite.

The sensors (S) of FIG. 3 may be the same as the sensors of FIGS. 1A-D. The sensors of FIG. 3 may also have features or capabilities, of monitors, such as cameras (not shown), to provide pictures of the operation. Surface sensors or gauges S may be deployed about the surface systems to provide information about the surface unit, such as standpipe pressure, hook load, depth, surface torque, rotary rpm, among others. Downhole sensors or gauges (S) are disposed about the drilling tool and/or wellbore to provide information about downhole conditions, such as wellbore pressure, weight on bit, torque on bit, direction, inclination, collar rpm, tool temperature, annular temperature and toolface, among others. The information collected by the sensors and cameras is conveyed to the various parts of the drilling system and/or the surface control unit.

The drilling system (310) is operatively connected to the surface unit (334) for communication therewith. The BHA (330) is provided with a communication subassembly (352) that communicates with the surface unit. The communication subassembly (352) is adapted to send signals to and receive signals from the surface using mud pulse telemetry. The communication subassembly may include, for example, a transmitter that generates a signal, such as an acoustic or electromagnetic signal, which is representative of the measured drilling parameters. Communication between the downhole and surface systems is depicted as being mud pulse telemetry, such as the one described in U.S. Pat. No. 5,517,464, assigned to the assignee of the present invention. It will be appreciated by one of skill in the art that a variety of telemetry systems may be employed, such as wired drill pipe, electromagnetic or other known telemetry systems.

Typically, the wellbore is drilled according to a drilling plan that is established prior to drilling. The drilling plan typically sets forth equipment, pressures, trajectories and/or other parameters that define the drilling process for the wellsite. The drilling operation may then be performed according to the drilling plan. However, as information is gathered, the drilling operation may deviate from the drilling plan. Additionally, as drilling or other operations are performed, the subsurface conditions may change. The earth model may also be adjusted as new information is collected.

FIG. 5.1 shows a schematic diagram depicting drilling operation of a directional well in multiple sections. The drilling operation depicted in FIG. 5.1 includes a wellsite drilling system (500) and a server and modeling tool (520) for accessing fluid in the target reservoir (500) through a bore hole (550) of a directional well (517). The wellsite drilling system (500) includes various components (e.g., drill string (512), annulus (513), bottom hole assembly (BHA) (514), Kelly (515), mud pit (516), etc.) as generally described with respect to the wellsite drilling systems (400) (e.g., drill string (315), annulus (326), bottom hole assembly (BHA) (330), Kelly (316), mud pit (322), etc.) of FIG. 3 above. As shown in FIG. 5.1, the target reservoir (500), being located away from (as opposed to directly under) the surface location of the well (517), may use special tools or techniques to ensure that the path along the bore hole (550) reaches the particular location of the target reservoir (500). For example, the BHA (514) may include sensors (508), rotary steerable system (509), and the bit (510) to direct the drilling toward the target guided by a pre-determined survey program for measuring location details in the well. Furthermore, the subterranean formation through which the directional well (517) is drilled may include multiple layers (not shown) with varying compositions, geophysical characteristics, and geological conditions. Both the drilling planning during the well design stage and the actual drilling according to the drilling plan in the drilling stage may be performed in multiple sections (e.g., sections (501), (502), (503), (504)) corresponding to the multiple layers in the subterranean formation. For example, certain sections (e.g., sections (501) and (502)) may use cement (507) reinforced casing (506) due to the particular formation compositions, geophysical characteristics, and geological conditions.

Further as shown in FIG. 5.1, surface unit (511) (as generally described with respect to the surface unit (334) of FIG. 4) may be operatively linked to the wellsite drilling system (500) and the server and modeling tool (520) via communication links (518). The surface unit (511) may be configured with functionalities to control and monitor the drilling activities by sections in real-time via the communication links (518). The server and modeling tool (520) may be configured with functionalities to store oilfield data (e.g., historical data, actual data, surface data, subsurface data, equipment data, geological data, geophysical data, target data, anti-target data, etc.) and determine relevant factors for configuring a drilling model and generating a drilling plan. The oilfield data, the drilling model, and the drilling plan may be transmitted via the communication link (518) according to a drilling operation workflow. The communication link (518) may comprise the communication subassembly (352) as described with respect to FIG. 4 above. Details of an example drilling operation workflow is describe with respect to FIG. 6 below.

The server and modeling tool (520) may be implemented on virtually any type of computer regardless of the platform being used. For example as shown in FIG. 5.2, the server and modeling tool (520) may be implemented on a computer system (580) that includes a processor (582), associated memory (584), a storage device (586), and numerous other elements and functionalities typical of today's computers. The computer system (580) may also include input means, such as a keyboard (688) and a mouse (590), and output means, such as a monitor (592). The computer system (580) may be connected to a local area network (LAN) (594) or a wide area network (e.g., the Internet) (594) via a network interface connection. Those skilled in the art will appreciate that these input and output means may take other forms.

Further, those skilled in the art will appreciate that one or more elements of the aforementioned computer system (580) may be located at a remote location and connected to the other elements over a network (594). Further, the oilfield well planning and operation may be implemented on a distributed system having a plurality of nodes, where each portion of the oilfield well planning and operation may be located on a different node within the distributed system. In one example, the node corresponds to a computer system. Alternatively, the node may correspond to a processor with associated physical memory. The node may alternatively correspond to a processor with shared memory and resources. Further, software instructions to perform embodiments may be stored on a computer readable medium such as a compact disc (CD), a diskette, a tape, a file, or any other computer readable storage device.

FIG. 5.3 shows a schematic diagram depicting anti-collision analysis. Here, wellsite (500) is depicted as a target wellsite with a planned trajectory (551) reaching a planned target (500) in a well design stage before the actual drilling of wellsite (500) depicted in FIG. 5.1 above. Cones of uncertainty (552) are included in the analysis to consider uncertainties during actual drilling activities from various factors such as uncertainties and tolerances of drilling tools, survey programs, formation conditions, etc. In addition, wellsite (560) depicts an offset well with offset trajectory (553), cone of uncertainty (554), and ellipsoid(s) of uncertainty (555). The offset well is typically drilled close to the target well to provide information (e.g., subsurface geology, pressure regimes, etc.) for planning the target well. The anti-collision analysis may be performed to ensure minimum separation (556) for proper operations of various aspects of the oilfield.

Figure 6:
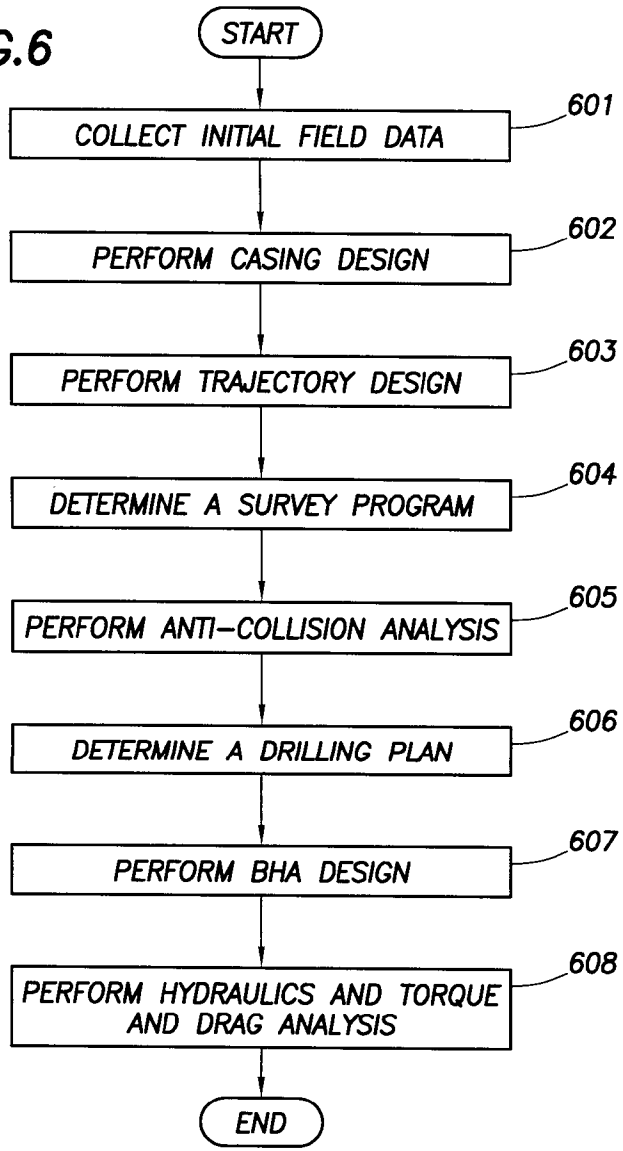
FIG. 6 shows a flow chart of a well design workflow of drilling operation.

FIG. 6 shows a flow chart of a well design workflow of drilling operation including blocks 601-607. The workflow may be performed utilizing the servers and modeling tools (520) of FIG. 5.1 above. Initially, oilfield data (e.g., historical data, actual data, surface data, subsurface data, equipment data, geological data, geophysical data, target data, anti-target data, etc.) is collected (601). The oilfield data may include, but is not limited to, basic information such as the surface location of the general area (e.g., the planned target wellsite (500) of FIG. 5.3), the location of a desired target reservoir (e.g., the planned target (500) of FIG. 5.3), the availability of rigs and other drilling equipment, the purpose of the target well (e.g., exploration, appraisal, production, injection, etc.), financial information (e.g., available budget), etc. Additional oilfield data may be obtained by querying a database (e.g., a distributed database with at least a portion being configured in the server and modeling tool (520) of FIG. 5.1) to find information from offset wells (e.g., the offset well (560) of FIG. 5.3), analog wells, etc. The analog wells may include a well that has some similarity to the planned target well where the similarity may be related to location, lithology (e.g., the macroscopic nature of the mineral content, grain size, texture, etc of formation rocks), formation structure, equipment used, drilling contractor employed, client for whom the well is drilled, basic geometry and type of the well, etc.

Once the data has been collected, casing design may be performed based on analysis of the collected data (602). The casing design may be performed in sections taking into account the different characteristics and conditions of various formation layers pertinent to the particular sections. As a result, the actual casing may be implemented separately in sections during the actual drilling stage as depicted in FIG. 5.1 above (e.g., sections (501), (502), (503), (504)). Generally, the planned trajectory (e.g., (551) of FIG. 5.3) may be determined taking into account the casing design in various formation layers to access the planned target (603). The design of the planned trajectory may be based on the choice of curves for the directional driller to follow, rapid changes in the trajectory (e.g., the inclusion of a dogleg in the art) in particularly crooked places in the bore hole, etc.

Following the trajectory design, a survey program is determined for surveying the bore hole trajectory during actual drilling (604). The survey program may include measurements of inclination (e.g., from vertical) and azimuth (or compass heading) made along various locations in the bore hole during the drilling for estimating the actual bore hole path to ensure that the drilling follows the planned trajectory. The surveying may be performed using, for example, simple pendulum-like measuring device or complex electronic accelerometers and gyroscopes, among others. For example, in simple pendulum measurements, the position of a freely hanging pendulum relative to a measurement grid is captured on photographic film, which is developed and examined when the tool is removed from the bore hole, either on wireline or the next time the pipe is tripped out of the borehole. The measurement grid is typically attached to the tool housing for representing the current relative location in the bore hole path. At least a portion of the uncertainty cone of the planned trajectory results from tolerances of such survey equipment and techniques. In general, survey factors may include trajectories, target location, survey measurements and devices used, survey error model, ellipse of uncertainty, geomagnetic model and influences, survey positions and associated ellipse of uncertainties of offset wells, lease lines and targets, survey program, etc. The survey factors may be determined based on the collected oilfield data through the various workflow blocks described above.

Furthermore, anti-collision analysis may be performed (605) based on the trajectory design and the survey factors as depicted in FIG. 5.3 above. Using the above information, a drilling plan may be determined (606). The drilling plan may set forth equipment, pressures, trajectories and/or other parameters that define the drilling process. The drilling plan may include planned trajectory, survey program, traveling cylinder, plots, etc. As described above, the drilling plan may be determined on a per-section basis along the planned trajectory taking into account the different formation layers along with planned trajectory. Many drilling factors may be considered in determining the drilling plan. The drilling factors may include sections to be drilled, lithology of each section, previous section conditions for current section, drill string to be used, casing string, rig type, water depth and air gap, rheology (e.g., elasticity, plasticity, viscosity, etc.) and mud properties, operation type, flow rate, mud weight, block weight, weight on bit, surface torque, rotations per minute, surface equipment properties, cutting size, friction factors, tortuosity, tripping schedule, etc.

Based on the drilling plan, the BHA may be designed (606) and hydraulics and torque and drag analysis performed on a per-section basis (607) to complete the well design workflow.

A scenario based drilling analysis method is described below, which provides the functionalities to integrate the various well design workflow blocks to facilitate evaluation of impacts induced from any changes in oilfield data and/or parameters considered in each well design workflow block. The scenario based drilling analysis method links inputs to the analysis, the corresponding analysis for a scenario, and the outputs of the analyzed scenario in a drilling model. Any changes in the oilfield data considered in well design stage or observed in actual drilling stage may generate another scenario for analysis. The drilling scenarios may be compared and the drilling model optimized using the scenario based drilling analysis method.

Figure 7:
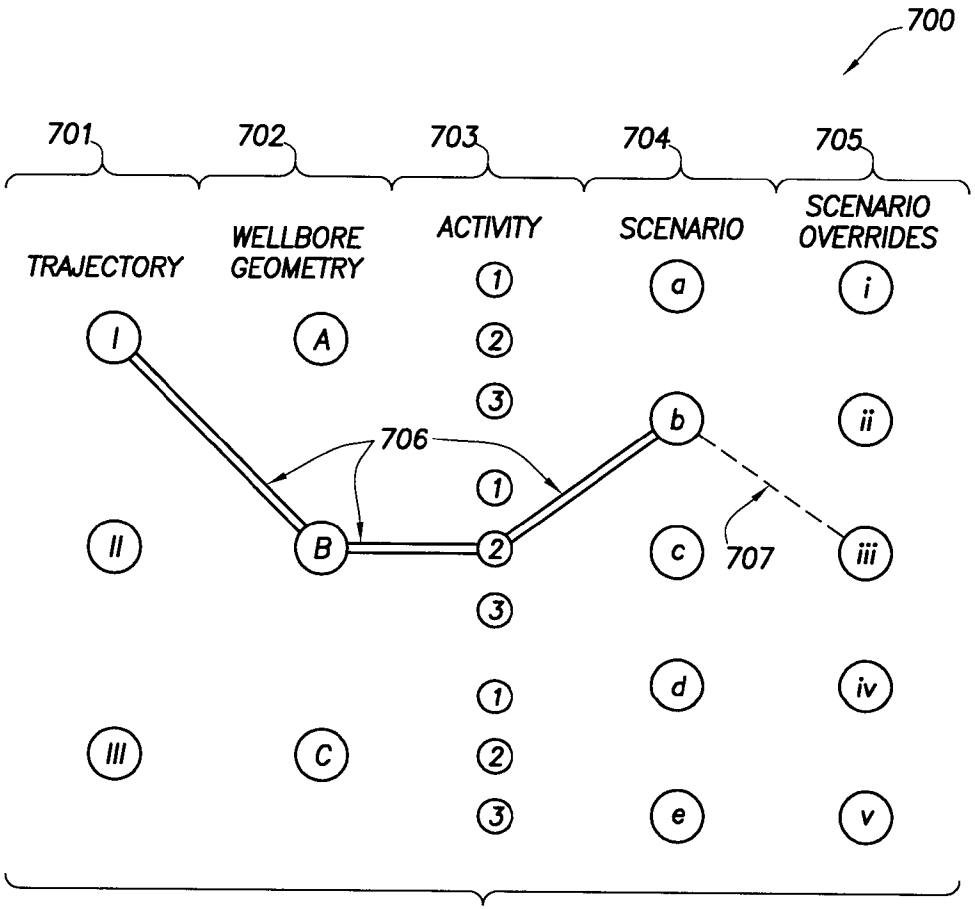
FIG. 7 shows a schematic diagram depicting an example drilling model of the scenario based drilling analysis.

FIG. 7 shows a schematic diagram depicting an example drilling model of the scenario based drilling analysis. Generally, there are many factors to consider throughout a well design workflow as described with respect to FIG. 6 above. The factors may include survey factors and drilling factors. These factors (e.g., planned trajectory, wellbore geometry, activity, tubular assembly, etc.) may be determined based on specific considerations to formulate many different possible combinations (e.g., a combination of a specific planned trajectory candidate, a specific wellbore geometry identified for the planned trajectory, a specific activity identified for analysis, a specific tubular assembly chosen for the activity, etc.).

Various analyses of these possible combinations may be performed throughout the well design workflow to optimize the drilling plan. In the scenario based drilling analysis, a scenario includes a particular combination of these factors, the analysis performed based on the particular combination, and the resultant drilling plan generated from the analysis.

As shown in FIG. 7, the drilling model (700) includes various factors (e.g., trajectory (701), wellbore geometry (702), activity (703)), scenario (704), and scenario overrides (705). Each of these factors is shown to include specific elements as available choices. For example, these factors are shown to include trajectory "I" through "III", wellbore geometry "A" through "C", and activity "1" through "3" for each wellbore geometry, respectively. Drilling scenarios "a" through "e" (also referred to herein as scenarios or scenario) are composed of combinations of specific elements. For example, scenario "b" may be represented by the link (706). For each scenario, scenario overrides "i" through "v" may be applied. For example, scenario override "iii" may be applied to the scenario "b", which is shown as the link (707). A scenario override represents a set of factors being overridden by default values/choices or omitted entirely. Additional details of scenario override are described later with respect to the sensitivity analysis.

The elements shown in FIG. 7 may be represented in the drilling model (700) using various data models. For example, domain objects with hierarchical structures may be used to represent these elements in the drilling model (700). Each domain object may represent a single entity (e.g., a specific trajectory, a specific wellbore geometry, a specific activity, a specific tubular assembly) and its attributes. A domain object may include other domain objects (e.g., a trajectory section, the wellbore geometry of a trajectory section, a sub-activity, a component of the tubular assembly such as a pipe component or a drill bit, etc.). A number of domain objects may also make up a higher level domain object (e.g., a well).

Further as shown in FIG. 7, scenario (706) includes elements of trajectory "I", wellbore geometry "B", and associated activity "2". The scenario (706) also includes the analysis (not shown) performed based on the particular combination of these elements and a resultant drilling plan (not shown). Each of the elements may include initial oilfield data collected in (601) of the workflow as described in FIG. 6 above. The initial oilfield data may include various components of the survey factors and drilling factors. For example, many fields of a domain object implementing these elements may be populated with these components of the survey factors, drilling factors, or combinations thereof. As the initial data may not be complete, the domain object may have unpopulated fields in its hierarchical structures. As analysis is performed throughout the well design workflow, intermediate results may be generated from outputs of a previous workflow block and be used as inputs of a subsequent workflow block. These intermediate results may be used to update the survey factors and drilling factors as well as to populate the initially unpopulated fields of the domain object. Different scenarios may be constructed based on different combinations of possible content in the domain object fields (i.e., possible values for each factors). Scenarios may be compared and evaluated to optimize resultant drilling plans. Scenarios may also be refined as additional input factors become available or determined and supplemental analysis being performed.

In addition, sensitivity analysis may be performed for each scenario using scenario overrides. Each of the scenario overrides "i" through "v" represents a set of factors being overridden by default values/choices or omitted entirely for performing alternative analysis of a scenario to compare impacts induced by the set of overridden factors. The sensitivity analysis provides the priority focus for the drilling model so that it can be used effectively based on factors exhibiting higher impacts to the analysis results. For example as shown in FIG. 7, a sensitivity analysis may be performed for the scenario (706) with scenario override "iii" to generate a new scenario as the combination of (706) and (707). The analysis related to the scenario (706) may be compared with that of the new scenario for performing the sensitivity analysis.

Although the example given above includes specific components (e.g., trajectory, wellbore geometry, activity, and tubular assembly) as elements in the drilling model factors, survey factors, drilling factors, and the scenario, one skilled in the art will appreciate that one or more of these factors may be omitted, replaced, or otherwise supplemented without deviating from the spirit of the invention.

The drilling model (700) is difficult to be conveyed to a user in the format as shown in FIG. 7 above. In addition, arbitrary combination of elements in the drilling model (700) may not be a physically possible scenario. Context may be defined to represent viable scenarios in the drilling model in a user friendly format. FIG. 8.1 shows a schematic diagram depicting context representation in a drilling model. A potentially viable scenario in the drilling model (700) may be represented to a user as a context. Contexts are shown in FIG. 8.1 based on scenario #1 (805), scenario #2 (806), scenario #3 (807), and 9" casing scenario (810), which form a tree hierarchy reflecting an analysis workflow. This hierarchy is shown here for analyzing various scenarios following proposal #1 of the planned trajectory using wellbore geometry WBG #1 (801). Here, the planned trajectory may be drilled in 10.5" sections (802). The WBG Activity (820) includes tubular activities (or a tubular run) used to construct a well. A sequential set of WBG Activities (e.g., drill section activity followed by BHA run or a sequence of casing activities) are used to define the state of the WBG in the order it is constructed. At the end of the activity, regardless of the Tubular Runs modeled below the activity, the WBG Activity is assumed to be complete and the construction is exactly as what was defined in the WBG Activity.

As shown in FIG. 8.1, the combination of drill section activity (803) and BHA run #1 (804) following the determined trajectory/WBA geometry (801) and the determined section (802), as well as the associated analysis compose the scenario #1. The combination of drill section activity (803) and BHA run #2 (811) following the determined trajectory/WBA geometry (801) and the determined section (802), as well as the associated analysis compose the scenario #2. The combination of drill section activity (803) and BHA run #2 (811) following the determined trajectory/WBA geometry (801) and the determined section (802), as well as the associated analysis compose the scenario #3 with a scenario override. The combination of 9" casing run (808) and casing run (809) following the determined trajectory/WBA geometry (801) and the determined section (802), as well as the associated analysis compose the scenario (810).

Accordingly, the scenarios are presented as contexts to allow the user to model specific cases for a particular tubular run. For example, in a BHA run, it may be interesting to know what the hook load and stress are in the drill string when tripping out at time TD. The corresponding scenario may be described as "Tripping Out at TD". Other scenarios may be described as "Rotating on bottom at 10500 ft", "High ROP near TD to check hole cleaning", etc. These scenarios may be displayed to the user as contexts in the entire tree hierarchy during the well design stage for the user to understand and navigate the construction options of a particular well. During actual drilling stage, the focus is generally on a single section at a time (e.g. WBG #1—10.5" Section). In this case, the context may be presented more concisely as shown in FIG.

8.2 to represent a section which is currently being drilled, about to be drilled, or has just been drilled. Using this concise context, user may provide inputs as appropriate for a particular task, such as a torque and drag analysis to supplement the scenario.

One of the problems associated with drilling is that the actual performance of the equipment in the field may not correspond to the modeled (or anticipated) performance. Because performance may depend on factors which may be unknown at the time of planning, the drilling plan may be sub-optimal. The scenario based drilling analysis method allows for improvements that enable dynamic re-planning by calibrating a drilling model in real time. As an illustrative example consider the performance of a rotary steerable BHA. The performance in terms of ability to change trajectory and ROP depends upon the RSS tool, the trajectory, the formation characteristics, the drill bit type and wear state, and the drilling parameters (e.g., weight-on-bit, RPM (rotation per minute), etc). During the well design stage, a performance model for the RSS BHA may be used. This model may initially be calibrated with data from offset wells and analog wells while assumptions may be made regarding factors such as expected lithology in the planned well. As the well is being drilled during the actual drilling stage, information regarding the actual performance, and details of the current lithology may then become available. This new information may be used to re-calibrate the performance model. The new model may then be available for re-planning the remaining sections of the well.

Figure 9:
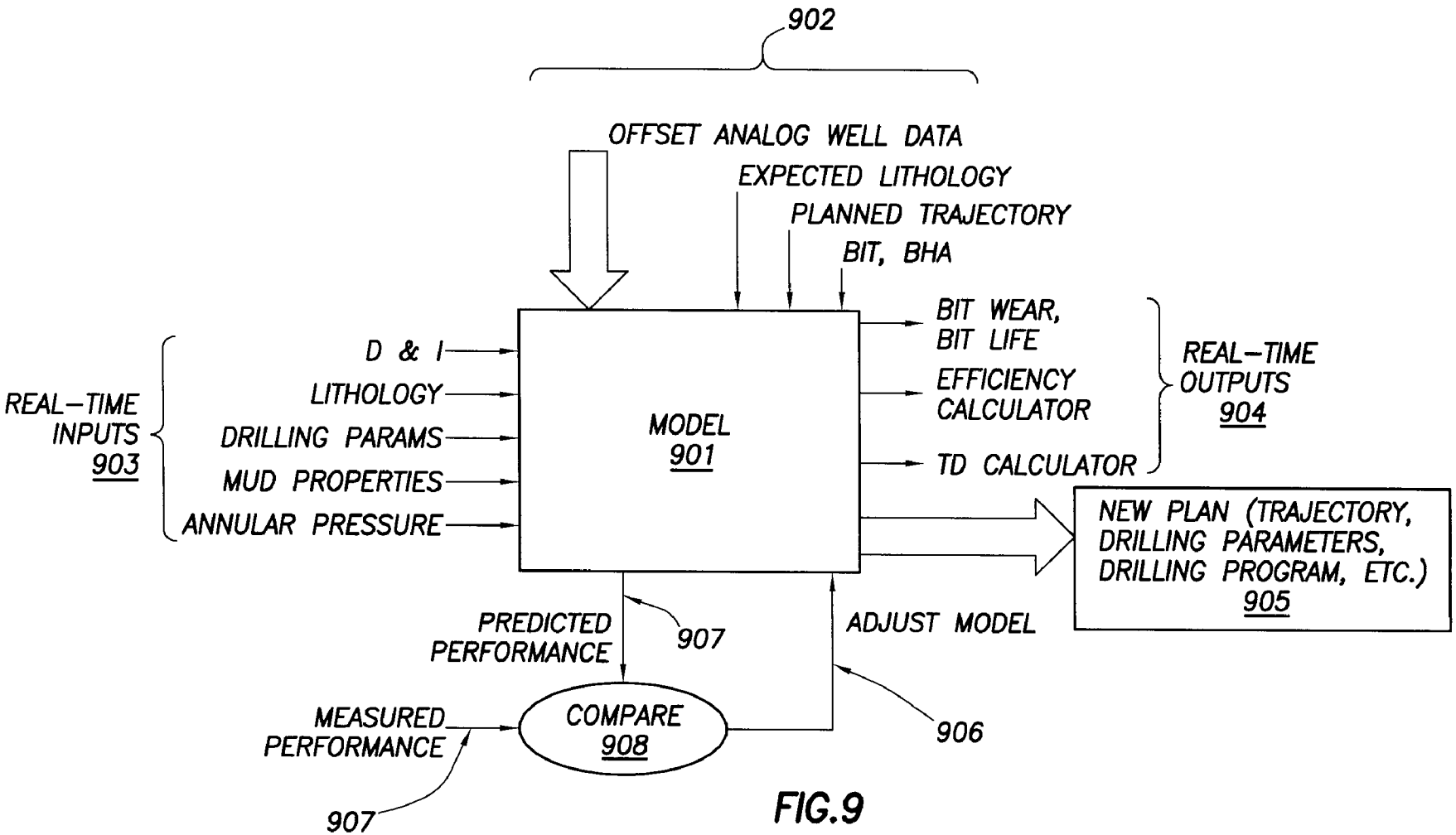
FIG. 9 shows a schematic diagram depicting modeling drilling operation in real time.

FIG. 9 shows a schematic diagram depicting modeling drilling operation in real time. The drilling model (901) may be the same as the drilling model (700) of FIG. 7. Initial oilfield data (902) such as offset well and analog well data, expected lithologies, planned trajectories, available selections of drill bit and BHA, etc. may be collected in constructing the drilling model (901). For example, these various information may be stored in the data fields of domain objects used to represent entities (e.g., a specific trajectory, a specific wellbore geometry, a specific activity, a specific tubular assembly as described with respect to FIG. 7 above) related to the drilling operation. An initial drilling plan (not shown) may be determined based on these initial data. Drilling may then be performed according to the initial drilling plan. Real-time inputs (903) such as inclination and azimuth, lithology, drilling parameters, mud properties, annular pressure, etc. may be provided to the drilling model (901) during the actual drilling stage. These real-time inputs may replace or supplement portions of the initial oilfield data and be stored, for example in the data fields of the domain objects (e.g., represent entities such as a specific trajectory, a specific wellbore geometry, a specific activity, a specific tubular assembly as described with respect to FIG. 7 above) in the drilling model (901).

Real-time outputs (904) such as bit wear, bit life, efficiency, etc. as well as predicted tool performance (907) may be generated from these real-time inputs based on functionalities configured in the drilling model (901). The predicted performance may include performance indicators such as hook load, inclination, azimuth, flow rate, build rate, turn rate, tool face angle, power setting, bit pressure drop, jet impact force, bias time, weight on bit, downhole weight on bit, surface RPM, bit RPM, drilling torque, off bottom torque, downhole torque, standpipe pressure, etc. The predicted performance may then be monitored and compared with the actual measured performance (907) to provide adjustment (906) to the model. Accordingly, an adjusted plan (905) may be generated by the drilling model (901) based on the scenario based drilling analysis method described with respect to FIG. 7 above. In one embodiment, the adjusted plan may be generated automatically in real time based on functionalities configured in the drilling model (901).

Because the drilling model may use detailed performance models supplemented with real-time data it may also be configured to produce detailed progress reports complete with an explanation of current performance and new predictions for future activity in the well bore. These reports will be based on the engineering models and data, accordingly, reduce subjectivity and ambiguity. The end result will be an improved understanding of the current well situation and more accurate predictions of future progress. These reports may be associated with the scenario from which it was generated. Once an item included in this scenario has been changed, for example by the user, the report will be flagged and may be regenerated automatically.

An example of the reports is a drill sheet including statistics of key performance indicators in consecutive rotating or sliding for a specific BHA run. A drill sheet is traditionally generated manually by the directional driller at the end of a BHA run, which may read as the following: Rotating for 2 hours from 3 AM to 5 AM, from 0 ft to 240 ft in average ROP 120 ft/hour. Then sliding for 10 minutes with average ROP 30 ft/hour, with average flow rate 200, maximum DLS (dog leg severity) 3 degree, etc. Then rotating again for another 2000 ft with average ROP 60 ft/hour (this might be a different formation).

The status of a drilling rig (e.g., rotating, sliding, etc.) is commonly referred to as rig state. A method for determining rig state (e.g., rotating, sliding , etc.) from real-time information during drilling process is described in U.S. Pat. No. 7,128,167 by Dunlop et al. and assigned to Schlumberger Technology Corporation. The real-time data may be analyzed with respect to the rig state for reporting to the user. Based on the real-time inputs (903), functionalities configured in the drilling model (901), and the method to determine rig state, a drill sheet may be generated automatically with additional performance indicators for each period of rotating or sliding identified by the rig state, such as hook load, inclination, azimuth, flow rate, build rate, turn rate, tool face angle, power setting, bit pressure drop, jet impact force, bias time, weight on bit, downhole weight on bit, surface RPM, bit RPM, drilling torque, off bottom torque, downhole torque, standpipe pressure, etc.

Figure 10:
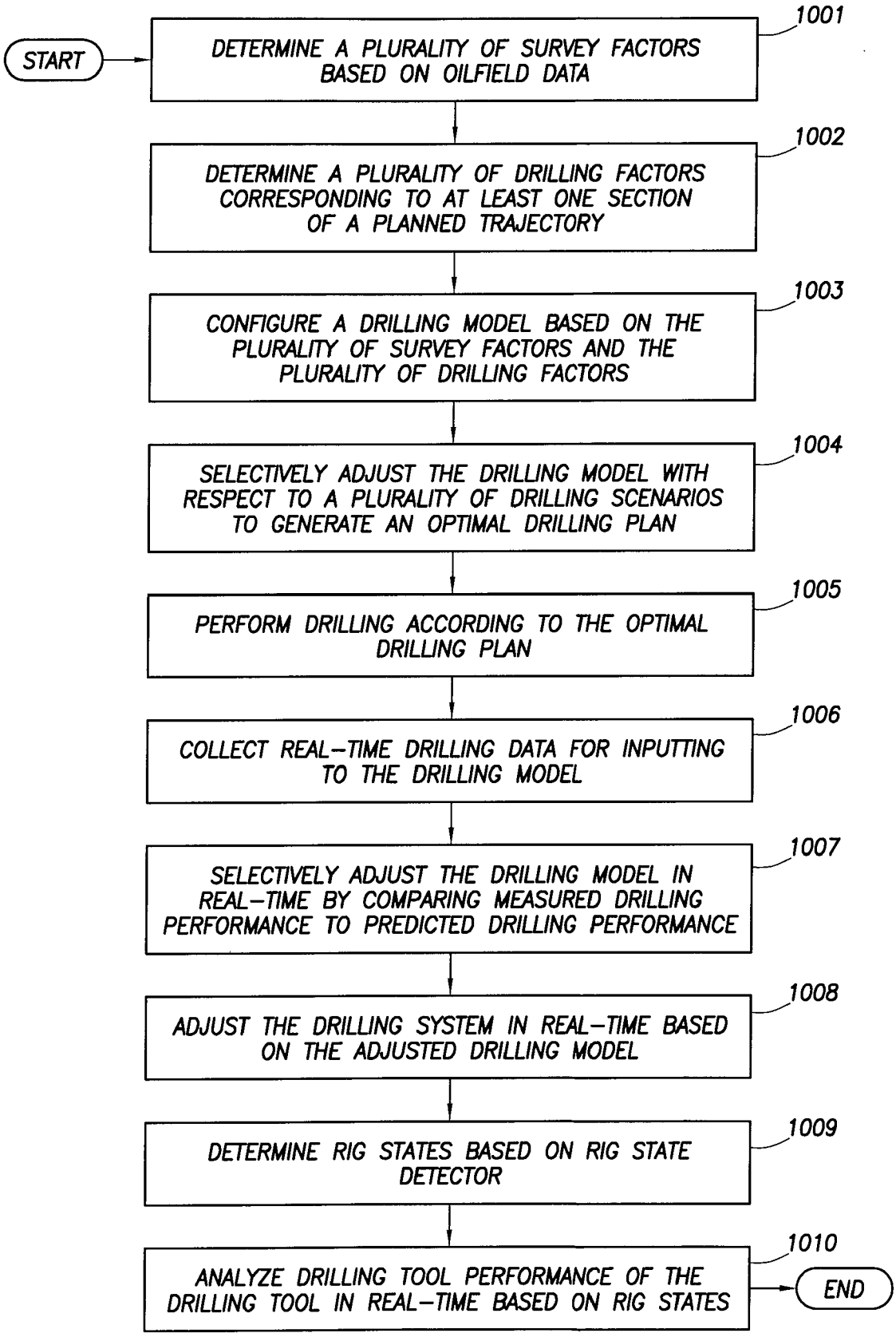
FIG. 10 shows a flow chart of a method for modeling drilling operation in an oilfield.

FIG. 10 shows a flow chart of a method, including blocks 1001-1010, for modeling a drilling operation in an oilfield. The method may be performed using, for example, the drilling model (700) of FIG. 7 for a drilling operation of FIG. 5.1. Initially, survey factors may be determined based on oilfield data (1001). The survey factors may include trajectories, target location, survey measurements and devices used, survey error model, ellipse of uncertainty, geomagnetic model and influences, survey positions and associated ellipse of uncertainties of offset wells, lease lines and targets, etc. The survey factors may be determined to form a survey program in the well design stage, for example as described with respect to FIG. 5.3. The survey program may be performed for estimating locations in the bore hole during the actual drilling stage, for example as described with respect to FIG. 5.1. The well design stage and the drilling stage may be performed in sections along the planned trajectory of a planned well.

Drilling factors may be determined for use in one or more sections (1002). The drilling factors may include sections to be drilled, lithology of each section, previous section conditions for current section, drill string to be used, casing string, rig type, water depth and air gap, rheology (e.g., elasticity, plasticity, viscosity, etc.) and mud properties, operation type, flow rate, mud weight, block weight, weight on bit, surface torque, rotations per minute, surface equipment properties, cutting size, friction factors, tortuosity, tripping schedule, etc.

The survey factors and drilling factors may then be used to configure a drilling model, for example the drilling model (700) of FIG. 7 (1003). The survey factors and drilling factors may correspond to data fields of domain objects representing entities related to the drilling operation. Specific determinations of these factors may be stored in these data fields to form various combinations of specific domain objects. Scenarios may then be composed from these combinations along with associated analysis and resultant drilling plan.

The scenarios may be compared with additional analysis performed to supplement the drilling model and determine an optimal drilling plan (1004). Accordingly, the drilling activities may be performed according to the optimal drilling plan (1005). Real-time drilling data may be collected during the drilling for inputting into the drilling model (1006). As a result, predicted performance indicators may be generated by the drilling model for comparison with the actual measured performance to adjust the drilling model in real time (1007). The drilling system may then be adjusted based on the adjusted drilling model in real time (1008). During the drilling stage, rig states may be determined based on a rig state detector (1009). The drilling tool performance may be analyzed in conjunction with the predicted performance indicators to be correlated with the rig states to automatically generate a drill sheet with detailed information (1010).

The blocks of the method are depicted in a specific order. However, it will be appreciated that the blocks may be performed simultaneously or in a different order or sequence. Further, throughout the method, the oilfield data may be displayed, the canvases may provide a variety of displays for the various data collected and/or generated, and he display may have user inputs that permit users to tailor the oilfield data collection, processing and display.

It will be understood from the foregoing description that various modifications and changes may be made in the preferred and alternative embodiments of the oilfield well planning and operation without departing from its true spirit. For example, the method may be performed in a different sequence, and the components provided may be integrated or separate.

This description is intended for purposes of illustration only and should not be construed in a limiting sense. The scope of this invention should be determined only by the language of the claims that follow. The term "comprising" within the claims is intended to mean "including at least" such that the recited listing of elements in a claim are an open group. "A," "an," and other singular terms are intended to include the plural forms thereof unless specifically excluded.

What is claimed is:

1. A system for performing a drilling operation for an oilfield, comprising:

a drilling system for advancing a drilling tool into a subterranean formation;

a repository storing:

a plurality of survey factors for at least one wellsite of the oilfield and a plurality of drilling factors corresponding to at least one section of a planned trajectory of the at least one wellsite, wherein the plurality of survey factors comprises analog well data for a plurality of analog wells and offset well data for a plurality of offset wells; and a processor and memory storing instructions when executed by the processor comprising functionality to:

identify an offset well of the plurality of offset wells, the offset well drilled close to the at least one wellsite to obtain a first portion of well data of the offset well data;

identify an analog well of the plurality of analog wells based on the plurality of survey factors and the plurality of drilling factors, the analog well comprising a similar condition as the at least one wellsite, wherein the similar condition is related to one selected from a group consisting of lithology, formation structure, equipment used, basic geometry, and well type of the at least one wellsite;

obtain the first portion of well data associated with the offset well;

obtain a second portion of well data from the analog well data associated with the analog well;

configure a drilling model for each of the at least one wellsite based on the plurality of survey factors, the plurality of drilling factors, the first portion of well data, and the second portion of well data; and selectively adjust the drilling model with respect to a plurality of drilling scenarios to generate an optimal drilling plan.

2. The system of claim 1, the instructions when executed by the processor further comprising functionality to:

perform drilling using the drilling system according to the optimal drilling plan;

collect real-time drilling data to generate a predicted drilling performance based on the drilling model;

obtain measured drilling performance; and selectively adjust the drilling model to generate an adjusted drilling model in real-time by comparing the measured drilling performance to the predicted drilling performance.

3. The system of claim 2, the instructions when executed by the processor further comprising functionality to:

adjust the drilling system in real-time based on the adjusted drilling model.

4. The system of claim 1, the instructions when executed by the processor further comprising functionality to:

perform drilling using the drilling system according to the optimal drilling plan;

obtain a rig state for a rig in which the drilling system is located; and analyze drilling tool performance of the drilling tool in real-time based on the rig state.

5. The system of claim 1, wherein the plurality of survey factors comprises at least one selected from a group consisting of trajectory, target location, survey measurement and device used, survey error model, ellipse of uncertainty, geomagnetic model and influence, and survey position, and wherein the plurality of drilling factors comprises at least one selected from a group consisting of a section to be drilled, lithology of the section, a section condition for the section, drill string to be used, casing string, rig type, water depth and air gap, rheology, mud property, operation type, flow rate, mud weight, block weight, weight on bit, surface torque, rotations per minute, surface equipment property, cutting size, friction factor, tortuosity, and tripping schedule.

6. The system of claim 1, wherein the drilling model comprises a plurality of domain objects for storing the plurality of survey factors and the plurality of drilling factors, and wherein at least one of the plurality of drilling scenarios comprises a combination that is determined based on the plurality of domain objects and analysis associated with the combination.

7. The system of claim 1, wherein the optimal drilling plan comprises a plurality of drilling plans corresponding to a plurality of sections to be drilled.

8. A method of performing a drilling operation for an oilfield, the oilfield having a drilling system for advancing a drilling tool into a subterranean formation, comprising:

determining a plurality of survey factors for at least one wellsite of the oilfield, wherein the plurality of survey factors comprises analog well data for a plurality of analog wells and offset well data for a plurality of offset wells;

determining a plurality of drilling factors corresponding to at least one section of a planned trajectory of the at least one wellsite;

identifying an offset well of the plurality of offset wells, the offset well drilled close to the at least one wellsite to obtain a first portion of well data of the offset well data;

identifying an analog well of the plurality of analog wells based on the plurality of survey factors and the plurality of drilling factors, the analog well comprising a similar condition as the at least one wellsite, wherein the similar condition is related to one selected from a group consisting of lithology, formation structure, equipment used, basic geometry, and well type of the at least one wellsite;

obtaining the first portion of well data associated with the offset well;

obtaining a second portion of well data from the analog well data associated with the analog well;

configuring a drilling model for each of the at least one wellsite based on the plurality of survey factors, the plurality of drilling factors, the first portion of well data, and the second portion of well data;

collecting real-time drilling data to generate a predicted drilling performance based on the drilling model;

determining measured drilling performance using real-time drilling data; and selectively adjusting the drilling model to generate an adjusted drilling model in real-time by comparing the measured drilling performance to the predicted drilling performance.

9. The method of claim 8, further comprising:

selectively adjusting the drilling model with respect to a plurality of drilling scenarios to generate an optimal drilling plan.

10. The method of claim 9, wherein the optimal drilling plan comprises a plurality of drilling plans corresponding to a plurality of sections to be drilled.

11. The method of claim 8, further comprising:

adjusting the drilling system in real-time based on the adjusted drilling model.

12. The method of claim 8, further comprising:

obtaining a rig state for a rig in which the drilling system is located; and analyzing drilling tool performance of the drilling tool in real-time based on the rig state.

13. The method of claim 8, wherein the plurality of survey factors comprises at least one selected from a group consisting of trajectory, target location, survey measurement and device used, survey error model, ellipse of uncertainty, geomagnetic model and influence, and survey position, and wherein the plurality of drilling factors comprises at least one selected from a group consisting of a section to be drilled, lithology of the section, a section condition for the section, drill string to be used, casing string, rig type, water depth and air gap, rheology, mud property, operation type, flow rate, mud weight, block weight, weight on bit, surface torque, rotations per minute, surface equipment property, cutting size, friction factor, tortuosity, and tripping schedule.

14. The method of claim 8, wherein the drilling model comprises a plurality of domain objects for storing the plurality of survey factors and the plurality of drilling factors, and wherein at least one of the plurality of drilling scenarios comprises a combination that is determined based on the plurality of domain objects and analysis associated with the combination.

15. A computer readable medium storing instructions for performing a drilling operation for an oilfield, the instructions comprising functionality to:

determine a plurality of survey factors for at least one wellsite of the oilfield, wherein the plurality of survey factors comprises analog well data for a plurality of analog wells and offset well data for a plurality of offset wells;

determine a plurality of drilling factors corresponding to at least one section of a planned trajectory of the at least one wellsite;

identify an offset well of the plurality of offset wells, the offset well drilled close to the at least one wellsite to obtain a first portion of well data of the offset well data;

identify an analog well of the plurality of analog wells based on the plurality of survey factors and the plurality of drilling factors, the analog well comprising a similar condition as the at least one wellsite, wherein the similar condition is related to one selected from a group consisting of lithology, formation structure, equipment used, basic geometry, and well type of the at least one wellsite;

obtain the first portion of well data associated with the offset well;

obtain a second portion of well data from the analog well data associated with the analog well;

configure a drilling model for each of the at least one wellsite based on the plurality of survey factors, the plurality of drilling factors, the first portion well data, and the second portion of well data;

advance a drilling tool into a subterranean formation of the oilfield according to the drilling model;

collect real-time drilling data from the drilling tool;

obtain a rig state for a rig in which the drilling tool is located; and analyze drilling tool performance of the drilling tool in real-time based on the rig state.

16. The computer readable medium of claim 15, the instructions further comprising functionality to:

selectively adjust the drilling model with respect to a plurality of drilling scenarios to generate an optimal drilling plan, wherein the drilling tool is advanced into the subterranean formation according to the optimal drilling plan.

17. The computer readable medium of claim 16, wherein the plurality of survey factors comprises at least one selected from a group consisting of trajectory, target location, survey measurement and device used, survey error model, ellipse of uncertainty, geomagnetic model and influence, and survey position, and wherein the plurality of drilling factors comprises at least one selected from a group consisting of a section to be drilled, lithology of the section, a section condition for the section, drill string to be used, casing string, rig type, water depth and air gap, rheology, mud property, operation type, flow rate, mud weight, block weight, weight on bit, surface torque, rotations per minute, surface equipment property, cutting size, friction factor, tortuosity, and tripping schedule.

18. The computer readable medium of claim 16, wherein the drilling model comprises a plurality of domain objects for storing the plurality of survey factors and the plurality of drilling factors, and wherein at least one of the plurality of drilling scenarios comprises a combination that is determined based on the plurality of domain objects and analysis associated with the combination.

19. The computer readable medium of claim 16, wherein the optimal drilling plan comprises a plurality of drilling plans corresponding to a plurality of sections to be drilled.

20. The computer readable medium of claim 15, the instructions further comprising functionality to:

generate a predicted drilling performance based on the drilling model;

determine measured drilling performance using real-time drilling data;

selectively adjust the drilling model to generate an adjusted drilling model in real time by comparing the measured drilling performance to the predicted drilling performance; and adjust the drilling system in real-time based on the adjusted drilling model.

* * * * *